US005972071A

United States Patent [19]

Koike et al.

[11] Patent Number: 5,972,071

[45] Date of Patent: Oct. 26, 1999

[54] ALUMINUM ALLOY FOR PISTON AND METHOD FOR PRODUCING PISTON

[75] Inventors: Toshikatsu Koike; Nanoki Tsuchida, both of Iwata, Japan

[73] Assignee: Yamaha Hatsudoki Kabushiki Kaisha, Iwata, Japan

[21] Appl. No.: 09/118,713

[22] Filed: Jul. 17, 1998

[30] Foreign Application Priority Data

Jul. 17, 1997 [JP] Japan ..... 9-192191

[51] Int. Cl.[6] ..... C22C 1/09; C22C 21/04

[52] U.S. Cl. ..... 75/255; 420/548

[58] Field of Search ..... 420/548; 419/17, 419/41, 43; 75/255

[56] References Cited

U.S. PATENT DOCUMENTS

| | | | |
|---|---|---|---|
| 2,707,136 | 4/1955 | Fahlman | 309/14 |
| 3,262,762 | 7/1966 | Bechtold | 29/182.5 |
| 3,853,635 | 12/1974 | Demendi | 148/3 |
| 4,000,026 | 12/1976 | Rexer | 156/49 |
| 4,434,014 | 2/1984 | Smith | 148/3 |
| 4,463,058 | 7/1984 | Hood et al. | 75/229 |
| 4,706,550 | 11/1987 | Bullat | 92/260 |
| 4,720,434 | 1/1988 | Kubo et al. | 428/567 |
| 4,865,806 | 9/1989 | Skibo et al. | 420/129 |
| 5,234,514 | 8/1993 | Donahue | 148/549 |

FOREIGN PATENT DOCUMENTS

| | | |
|---|---|---|
| 0153 473 A2 | 12/1984 | European Pat. Off. . |
| 1226350 | 7/1960 | France . |
| 3719121 A1 | 12/1988 | Germany . |
| 3822031 A1 | 1/1990 | Germany . |
| 63-126661 | 5/1988 | Japan . |
| 63-132743 | 6/1988 | Japan . |
| 1-180927 | 7/1989 | Japan . |
| 2-107749 | 8/1990 | Japan . |
| 2-233858 | 9/1990 | Japan . |
| 9-76042 | 3/1997 | Japan . |
| 449 719 | 1/1971 | Switzerland . |

*Primary Examiner*—Daniel J. Jenkins
*Attorney, Agent, or Firm*—Knobbe, Martens, Olson & Bear LLP

[57] ABSTRACT

An aluminum alloy for pistons and a method of manufacturing pistons making use of said alloy, enabling casting without sacrificing the ease of casting, and restricting deformation and melting at high temperatures, and fatigue and wear caused by high speed sliding movement. The aluminum alloy contains Si+SiC in an amount in the range of 8% to 20% by weight, and SiC in an amount of 2% or more by weight. An ingot containing the aluminum alloy is melted, sprayed in the state of mist, rapidly cooled and solidified into rapidly cooled powder. The rapidly cooled powder is heated and solidified into a blank from which the piston is forged, heat-treated, and machined.

2 Claims, 4 Drawing Sheets

ALUMINUM ALLOY FOR PISTON AND METHOD FOR PRODUCING PISTON

BACKGROUND OF THE INVENTION

This invention relates to a piston particularly utilized in an internal combustion engine and more particularly to an improved alloy for such pistons and method for manufacturing them.

As is well known, the piston for an internal combustion engine has a number of rigid and yet diverse requirements. That is, the piston should be light in weight and yet also high in strength. The sliding surfaces of the piston should provide low friction and be able to withstand high compressive forces. Furthermore, different areas of the piston have quite different conditions which they must withstand. For example, the head of the piston must be capable of withstanding high temperatures as occur during combustion and also the coefficient of thermal expansion should be controlled so as to minimize the differences in dimensional clearances between the piston and the cylinder bore during temperature changes as occur in engine operation.

Conventionally, aluminum has been utilized as the basic material for pistons in engines. In order to improve the characteristics of the piston, frequently silicon (Si) is employed as an alloying element. By adding silicon, the ability to cast the piston can be improved since the melting point is lowered and the flow of molten material is facilitated. Also, the silicon resists deformation at high temperatures by lowering the coefficient of thermal expansion. In addition, resistance against wear and fatigue under high speed sliding action is improved.

Certain of these characteristics such as the lowering of the thermal expansion and the improved resistance against wear are somewhat proportional to the amount of silicon used in the alloy. Thus, the output of the engine and thermal load on the piston the greater amount of silicon is added.

However, silicon has a considerably lower thermal conductivity than aluminum. Thus, aluminum alloys having large amounts of silicon have low thermal conductivity. Therefore, heat dissipation is deteriorated and thus, overheating particularly in the head area results. In fact, the degree of overheating may be such that actual melting of the piston head may occur.

It is, therefore, a principal object of this invention to provide an aluminum alloy for use in forming pistons that will provide improved strength and heat dissipation performance.

It is a further object of this invention to provide an aluminum alloy for use in forming pistons that will increase thermal conductivity without increasing the coefficient of thermal expansion and to improve resistance against wear and fatigue strength, particularly under conditions of high temperature and high speed.

In conjunction with the formation of the piston from the material, it is also important to ensure that the properties of the material and way in which the piston is formed is such that cracks cannot develop during the formation process. The use of silicon and silicon and certain other alloying materials can give rise to problems in connection with forming the piston which can result in defects being created in the actual forming process.

It is, therefore, a still further object of this invention to provide an improved method for forming a piston.

SUMMARY OF THE INVENTION

This invention is adapted to embodied in an aluminum alloy that is utilized for forming pistons. The aluminum alloy includes silicon and a silicon carbide combined in a proportion that lies within the range of 8–20% by weight and which contains at least 2% of silicon carbide by weight.

In a method for forming pistons using an aluminum alloy as set forth in the preceding paragraph, the piston is forged from a powder that is formed by melting an ingot containing the aluminum alloy, atomizing the melted ingot and rapidly cooling it to produce a solidified powder. The powder is heated into and solidified into a blank which is then forged into the final shape for the piston.

DETAILED DESCRIPTION OF THE PREFERRED EMBODIMENTS

Figure 1:
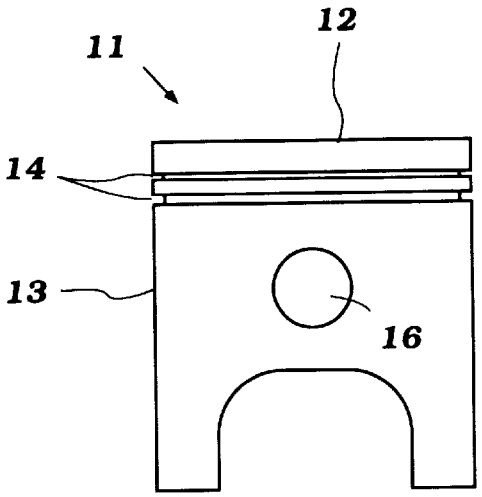
FIG. 1 is a side elevational view of a piston constructed in accordance with an embodiment of the invention.
Figure 2:
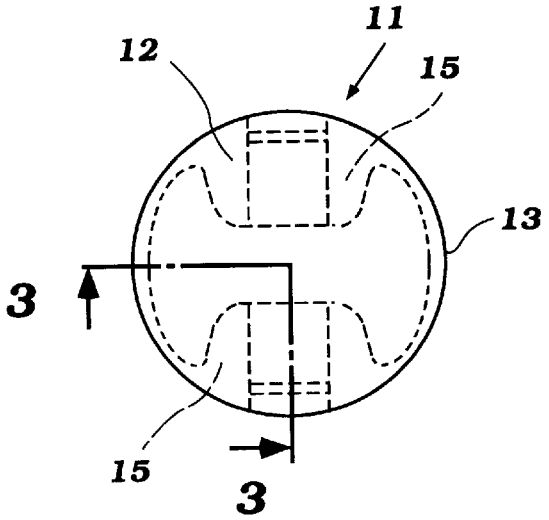
FIG. 2 is a top plan view of the piston.
Figure 3:
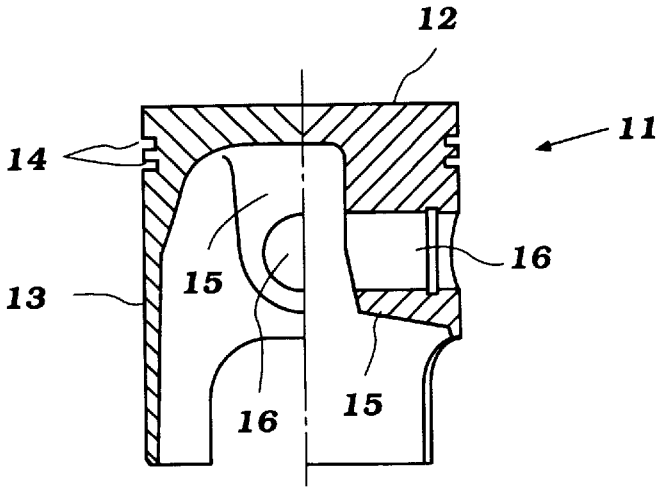
FIG. 3 is a cross-sectional view of the piston taken along the line 3—3 of FIG. 2.

Referring first to FIGS. 1–3, a piston that is constructed from a material that embodies a feature of the invention and which is formed by a process embodying the invention is identified generally by the reference numeral 11. The piston 11 is comprised of a head portion 12 from which a skirt portion 13 depends. The head portion 12 is formed at its upper end with piston ring grooves 14.

Bridging the head portion 12 and the skirt portion 13, are piston pin bosses 15 in which piston pin receiving openings 16 are formed for receiving a piston pin that couples the piston 11 to an associated connecting rod for utilization in any form of internal combustion engine in a manner known in the art.

The invention deals primarily with the material from which the piston is formed and the manner in which the piston 11 is formed. This will now be described, first by listing specific examples of aluminum alloys that achieve the desired results and which embody the invention.

FIRST EXAMPLE

An aluminum alloy consisting of the following alloying components in the noted percentages by weight:

5–25% of Si

1–3% of Fe 0.5–5% of Cu 0.5–5% of Mg

2% or less of Mn

2% or less of Ni

2% or less of Cr

2% or less of Zr

2% or less of Mo

1–10% of SiC

The average grain diameter of SiC is about 1–20 μm.

SECOND EXAMPLE

An aluminum alloy consisting of the following alloying components in the noted percentages by weight:

5–25% of Si

1–3% of Fe 0.5–5% of Cu 0.5–5% of Mg

2% or less of Mn

2% or less of Ni

2% or less of Cr

2% or less of Zr

2% or less of Mo

1–10% of SiC (and BN or AlN or $Al_2O_3$)

In this example if any of the last listed ingredients other than SiC, or BN, i.e. AlN and $Al_2O_3$, are additionally employed the total weight component of all of those ingredients may be within the range of 1–10% in total. However some SiC is essential.

THIRD EXAMPLE

An aluminum alloy consisting of the following alloying components in the noted percentages by weight:

5% or less of Si

5% or more of Fe 0.5–5% of Cu 0.5–5% of Mg

2% or less of Mn

2% or less of Ni

2% or less of Cr

2% or less of Zr

2% or less of Mo

1–10% of SiC

In this example the average grain diameter of SiC is 1–20 μm.

FOURTH EXAMPLE

An aluminum alloy consisting of the following alloying components in the noted percentages by weight:

5% or less of Si

5% or more of Fe 0.5–5% of Cu 0.5–5% of Mg

2% or less of Mn

2% or less of Ni

2% or less of Cr

2% or less of Zr

2% or less of Mo

1–10% of SiC (and BN or AlN or $Al_2O_3$)

In this example if any of the last listed ingredients other than SiC, or BN, i.e. AlN and $Al_2O_3$, are additionally employed the total weight component of all of those ingredients may be within the range of 1–10% in total. However some SiC is essential.

FIFTH EXAMPLE

An aluminum alloy consisting of the following alloying components in the noted percentages by weight:

5% or less of Si

5% or more of Fe 0.5–5% of Cu 0.5–5% of Mg

2% or less of Mn

2% or less of Ni

2% or less of Cr

2% or less of Zr 2% or less of Mo

1–10% of C or $MoS_2$

1–10% of SiC ($Al_2O_3$ may be added within a range of 1–10% in total. However some SiC is essential.

In this example, only one of C and $MoS_2$ or both may be used within a range of 1–10% in total.

SIXTH EXAMPLE

An aluminum alloy consisting of the following alloying components in the noted percentages by weight:

5–25% of Si

1–10% of Fe 0.5–5% of Cu 0.5–5% of Mg

2% or less of Mn

2% or less of Ni

2% or less of Cr

2% or less of Zr

2% or less of Mo

1–10% of SiC

In this example, the average grain diameter of SiC is 1–20 μm.

SEVENTH EXAMPLE

An aluminum alloy consisting of the following alloying components in the noted percentages by weight:

5–25% of Si

1–10% of Fe 0.5–5% of Cu 0.5–5% of Mg

2% or less of Mn

2% or less of Ni

2% or less of Cr

2% or less of Zr

2% or less of Mo

1–10% of SiC (and BN or AlN or $A_2O_3$)

In this example if any of the last listed ingredients other than SiC, or BN, i.e. AlN and $Al_2O_3$, are additionally employed the total weight component of all of those ingredients may be within the range of 1–10% in total. However some SiC is essential.

EIGHTH EXAMPLE

An aluminum alloy consisting of the following alloying components in the noted percentages by weight:

5–25% of Si

1–10% of Fe 0.5–5% of Cu 0.5–5% of Mg

2% or less of Mn

2% or less of Ni

2% or less of Cr

2% or less of Zr

2% or less of Mo

1–10% of C or $MoS_2$

1–10% of SiC ($Al_2O_3$ may be added within a range of 1–10% in total. However, some SiC is essential.)

In this example, only one of C and $MoS_2$ or both may be used within a range of 1–10% in total.

NINTH EXAMPLE

An aluminum alloy consisting of the following alloying components in the noted percentages by weight 5–25% of Si 1% or less of Fe 0.5–5% of Cu 0.5–5% of Mg 2% or less of Mn 2% or less of Ni 2% or less of Cr 2% or less of Zr 2% or less of Mo 5% or less of SiC (and BN or AlN or $Al_2O_3$)

In this example if any of the last listed ingredients other than SiC, or BN, i.e. AlN and $Al_2O_3$, are additionally employed the total weight component of all of those ingredients may be within the range of 1–10% in total. However some SiC is essential.

TENTH EXAMPLE

An aluminum alloy consisting of the following alloying components in the noted percentages by weight:

5–25% of Si

1% or less of Fe 0.5–5% of Cu 0.5–5% of Mg

2% or less of Mn

2% or less of Ni

2% or less of Cr

2% or less of Zr

2% or less of Mo

1–10% of C or $MoS_2$

5% or less of SiC ($Al_2O_3$ may be added within a range of 1–10% in total. However, SiC is essential.)

In this example, only one of C and $MoS_2$ or both may be used within a range of 1–10% in total.

In each of the above described embodiments, the alloying elements C and/or $MoS_2$ are for improving the sliding friction properties. The ingredient Si is added to improve wear resistance and heat resistance by producing hard crystal silicon grains of initial or eutectic crystals in the metallic composition. The alloying element Fe (iron) is added to produce a dispersed metallic composition so as to provide a high strength at temperatures over 200° C. The ingredients Cu (copper) and Mg (magnesium) are added to increase strength at temperatures under 200 C. The intended resistance against wear and seizure and the necessary strength at high temperatures can not be attained outside the ranges of the above-described embodiments.

Table 1 shows the ingredients of conventional aluminum alloys AC8A and AC9B specified in Japanese Industrial Standards (JIS) and which are conventionally used for pistons. Alloy 1 and Alloy 2 are aluminum alloy examples of the present invention and taken from the above listed examples.

TABLE 1

(in % by weight)

| | Si | Cu | Mg | Ni | Fe | SiC | Si + SiC |
|---|---|---|---|---|---|---|---|
| JIS AC8A | 12 | 1 | 1 | 1 | — | — | 12 |
| JIS AC9B | 19 | 1 | 1 | 1 | — | — | 19 |
| Alloy 1 | 10 | 1 | 0.5 | — | 5 | 2 | 12 |
| Alloy 2 | 17 | 1 | 0.5 | — | 5 | 2 | 19 |

Figure 4:
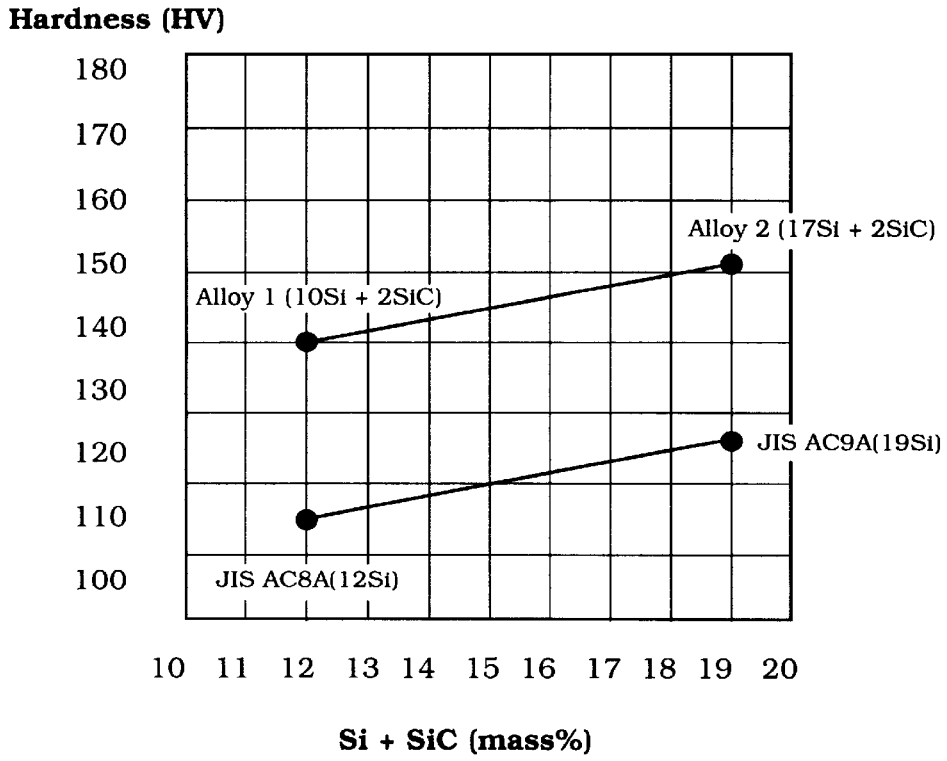
FIG. 4 is a graphical view showing the hardness relative to the total percent by weight of silicon and silicon carbide for prior art type piston materials and those embodying the invention.

FIG. 4 shows comparison of hardness property data between the conventional aluminum alloys AC8A, AC9B, and the alloys 1, 2 of the invention. As seen from the figure, the hardness properties of the alloys 1 and 2 of the invention are superior to those of the alloys AC8A and AC9B.

Figure 5:
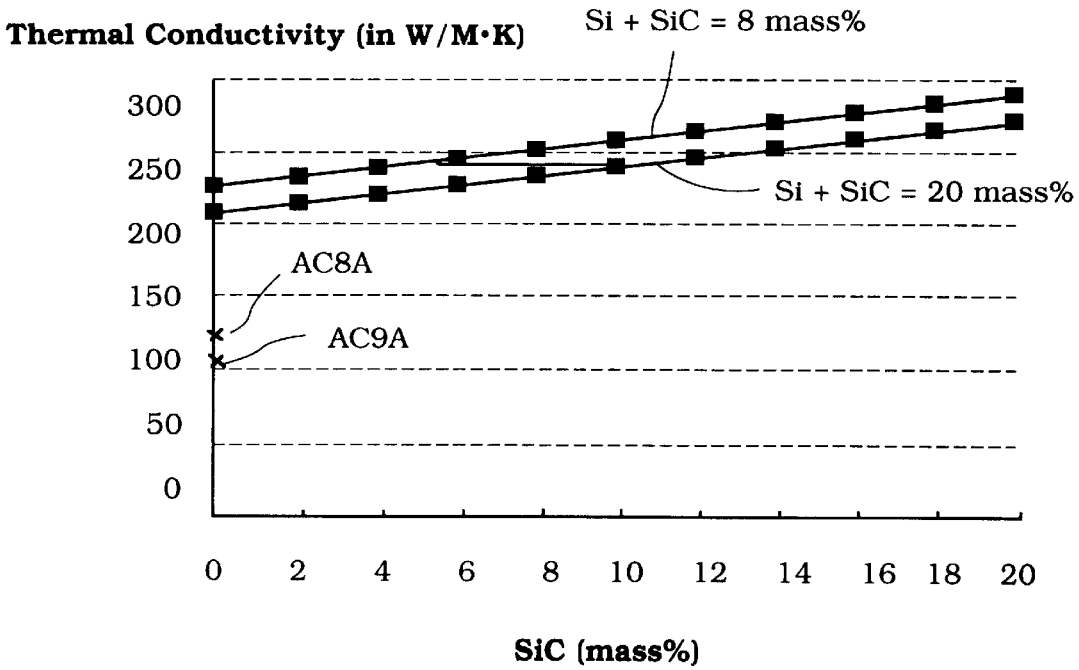
FIG. 5 is a graphical view showing the thermal conductivity in relation to the percent by weight of silicon carbide for the materials shown in FIG. 4.

FIG. 5 shows the comparison of thermal conductivity (in watt per meter per Kelvin) between the aluminum alloys of the invention respectively containing 8% and 20% of Si+SiC by weight, and the above-mentioned conventional alloys AC8A and AC9B. As seen from this figure, the alloys of the invention are higher in thermal conductivity than the alloys AC8A and AC9B which do not contain SiC. Therefore, the alloys of the invention, when used for pistons, improve heat dissipation property, and enable the use under conditions of high output at high temperatures.

Figure 6:
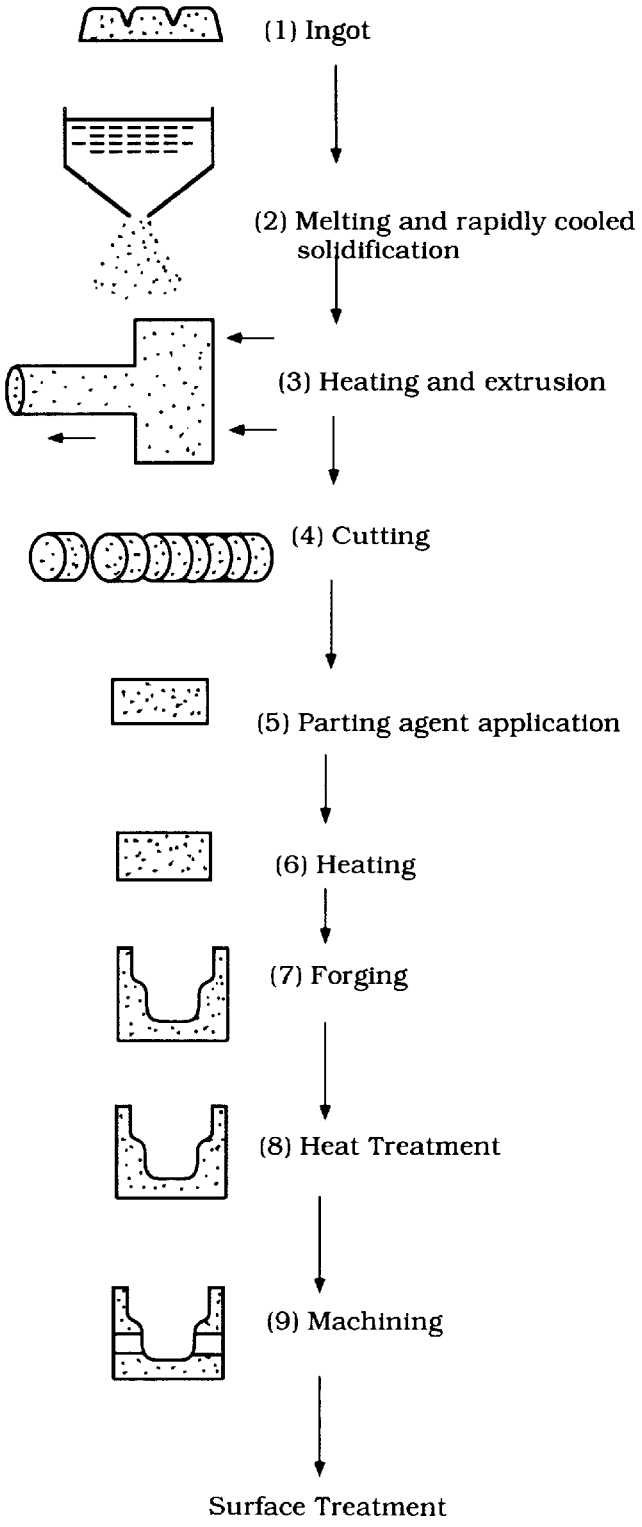
FIG. 6 is a graphical view showing the steps in forming both the material from which the piston is formed and the final piston.

Now the method of manufacturing the piston using the aluminum alloys of the invention will be described by reference to FIGS. 6 and 7. FIG. 6 shows an example of the method of manufacturing a piston 11 in accordance with an embodiment of the invention.

First in the process step (1), an aluminum alloy ingot is prepared from aluminum (Al) containing alloying materials including silicon (Si), iron (Fe), and other ingredients as in any of the previously enumerated examples. Next in the process step (2), one or several kinds of ingots are melted at a temperature of 700° C. or higher then atomized in a sprayed mist state, and rapidly cooled at a rate of 100° C. per second to solidify into rapidly cooled powdered metal of aluminum alloy.

Then in the process step (3), the rapidly cooled powdered metal of aluminum alloy is heated up to 400–500° C., and extruded to solidify into a round aluminum alloy bar. Then in the process step (4), the round aluminum alloy bar is cut into thick disk-shaped forging blanks, each having an appropriate size corresponding to the piston made by forging according to the present embodiment.

Here, in addition to the above-described method of forming the forging blanks for the forged pistons by cutting the extruded round aluminum alloy bar into pieces of intended shape and size, it is also possible to form the forging blanks of intended shape and size more directly for example by packing a mold with the aluminum alloy powder, and heating up to 400–500° C. under pressure.

Also it is possible to form the forging blanks of the thick disk shape for forging the pistons by heating aluminum alloy powder up to 400–500° C. under pressure, by introduction to and subsequently rolling between a pair of pressing rolls. Alternately they may be formed in a punch press. It is also possible to cut the rolled material into rectangular forging blanks of a desired size for the forged process and the rectangular forging blanks may be preliminarily forged into thick disk-shaped forging blanks before the forging process.

Regardless of how the blank is pressure formed, at the processes step (5) a parting agent is applied to the outside surface of the blank. Then it is heated at the step (6) to improve the ease of forming. The forging is then done at the step (7) by squeezing the blank with paired upper and lower forging dies.

The piston like blank formed by forging as described above is then subjected to the process step (8) of heat treatment for increasing strength and the final process step (9) of machining to form the piston ring grooves 14 and the piston pin bore 16. Any necessary final trimming and or/machining may then be performed to provide the final shape of the piston.

Furthermore, if required, the piston finished as described above is processed by surface treatment such as plating on the skirt portion 13 for improving the sliding property and wear resistance.

Figure 7:
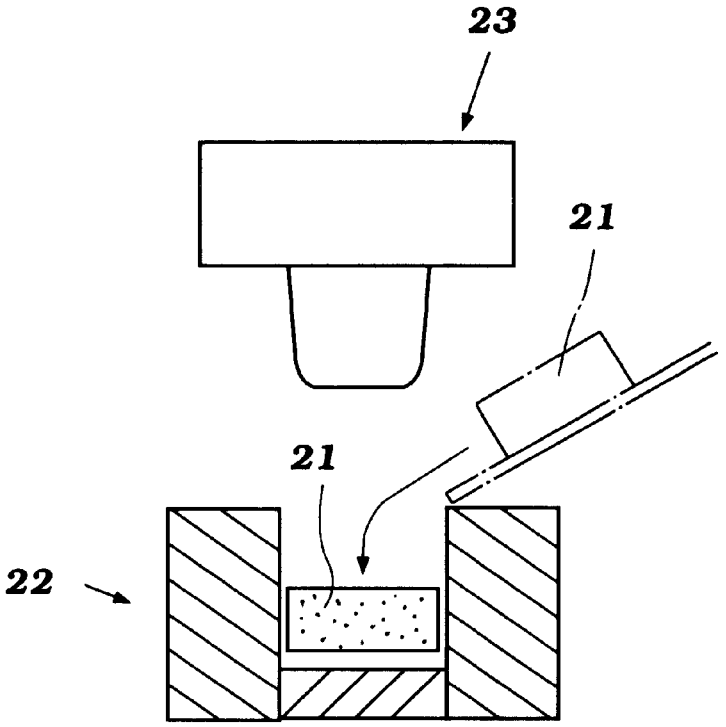
FIG. 7 is a partially schematic cross-sectional view showing the initial detail of the forging step as illustrated in FIG. 6.
Figure 8:
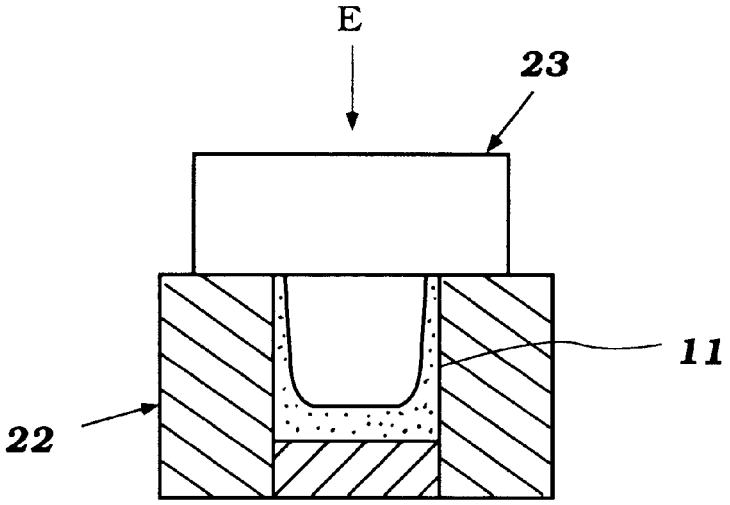
FIG. 8 is a cross-sectional view, in part similar to FIG. 7 and shows the completion of the forging step.

The actual forging of the blank into the piston in the processes (6) and (7) is shown in FIGS. 7 and 8. As shown in FIG. 7 a blank 21 of a thick disk shape is positioned in the recessed portion of a lower mold 22 that is preheated up to a controlled temperature between 200 and 500° C. Then as shown in FIG. 8, the blank 21 is pressed into the shape of the piston with the upper mold (punch) 23 pre-heated up to a controlled temperature between 200 and 500° C. In this way, the primary formed blank of the piston piece may be formed by hot forging using the upper and lower molds 23 and 22 preheated to the controlled temperature with good dimensional accuracy while making good use of the ductility of the aluminum alloy.

Also, the forging blank 21 may be heated up to a temperature between 200 and 500° C. before being placed in the forging dies 22 and 23, then placed in the recess of the lower die 22, and immediately forged with the upper die 23. In that case too, the forging is carried out while controlling the temperature of the upper and lower dies 22 and 23 between 200 and 500° C. In this way, the forging time may be shortened with the separate, parallel processes of forging and forging blank heating.

As described above, the forging blank for the forged piston of the aluminum alloy is made by melting and spraying the aluminum alloy, solidifying by rapid cooling to produce solidified powder, and then forming and solidifying the powder. As a result, the average grain diameter of the aluminum alloy power is about 100 $\mu$m.

The average grain diameter of the ingredients Si and SiC contained in the aluminum alloy is as small as 20 $\mu$m or less and distributed to each grain of the aluminum alloy, while the initial crystal silicon grains used in forming the base ingot are much larger.

As a result, the forged piston for internal combustion engines of the present embodiment primarily forged using the forging blank of the present embodiments containing the ingredients of Si and SiC in dispersed fine grains is free from cracks which would otherwise result from fracture of grains of initial crystal silicon in the skirt portion 13. This is true even if the skirt portion 13 in particular is made to be thin-walled. Therefore the resulting piston 11 has a high fatigue strength particularly in the skirt portion 13.

The dispersion of the Si and SiC in fine grains in the aluminum alloy, may also be done after the aluminum alloy is rapidly cooled and solidified to produce an aluminum alloy powder. Then Si and SiC having average grain diameter of 1–20 $\mu$m is mixed by an amount that produces the mixture ratios of the aluminum alloy examples given above. The blanks 21 are formed directly to the required size by pressing and heating at a temperature below 700° C. This results in Si and SiC of average grain diameter smaller than 20 $\mu$m dispersed in the boundary area of the aluminum alloy powder composition.

If the primary forming of the piston is made by a normal casting process using an aluminum alloy as a forging blank containing a large amount of iron as an additive, coarse grains of iron compound are produced as the material is cooled after casting, resulting in lowering in strength. However, in the present embodiment, since the aluminum alloy is made into powder by rapid cooling and made into the forging blank for the forged piston by heating under pressure, coarse grains of iron compound are prevented from being produced. Therefore, a uniform metallic composition is provided free from coarse iron compound grains which may cause stress concentration. As a result, iron may be added in a large amount to provide an alloy having a high fatigue strength.

The forging blank for the forged piston and the forged piston itself for internal combustion engines of the present embodiment according to the invention containing SiC as described above contains a specified amount of SiC which is harder than Si so as to increase the wear resistance.

Another embodiment of the forging blank for the forged piston and the forged piston itself for internal combustion engines of the present invention containing SiC as described above may be effected as follows: For example in the process (2) shown in FIG. 6, an aluminum alloy ingot not containing SiC is melted and sprayed in the state of mist, rapidly cooled and solidified into powder (powdered metal). A specified amount of SiC having an average grain diameter of 1–20 $\mu$m is mixed into the powdered metal so that the forging blank for the piston made with the rapidly cooled, solidified powder contains SiC and that SiC and Si having an average grain diameter of 20 $\mu$m or less are distributed in the boundary area of the aluminum alloy powder composition having average grain diameter of about 100 $\mu$m.

We claim:

1. An aluminum alloy powder for forming pistons for an internal combustion engine by forging, said alloy containing aluminum alloyed with Si and SiC in a range from 8% to 20% by weight and containing at least 2% or more of SiC by weight and being transformed into a powder by melting an ingot having said alloy content and spraying the melt into a cooling stream.

2. An aluminum alloy for pistons as set forth in claim 1 wherein average grain diameters of the Si and SiC before the spraying is less than 20 $\mu$m.

* * * * *